US005380379A

United States Patent [19]

Maiwald et al.

[11] Patent Number: 5,380,379

[45] Date of Patent: Jan. 10, 1995

[54] ALUMINUM FOIL PRODUCT AND MANUFACTURING METHOD

[75] Inventors: Klaus P. Maiwald, Thun, Switzerland; Marcio D. Soares; Aldenir J. Clemente, both of Pernambuco, Brazil

[73] Assignee: Alcoa Aluminio Do Nordeste S.A., Itappissuma, Brazil

[21] Appl. No.: 108,476

[22] Filed: Aug. 18, 1993

[51] Int. Cl.[6] ..... C22F 1/04; C22C 21/00

[52] U.S. Cl. ..... 148/697; 148/438; 148/696; 420/538; 420/551

[58] Field of Search ..... 428/606; 148/437, 438, 148/695, 696, 697; 420/538, 550, 551

[56] References Cited

U.S. PATENT DOCUMENTS

| | | | |
|---|---|---|---|
| 3,397,044 | 8/1968 | Bylund | 420/550 |
| 3,814,590 | 6/1974 | Bylund | 29/183 |
| 3,989,548 | 11/1976 | Morris | 148/2 |
| 4,164,434 | 8/1979 | Fister et al. | 420/551 |
| 4,483,719 | 11/1984 | Furrer et al. | 148/2 |
| 4,671,985 | 6/1987 | Rodrigues et al. | 428/215 |
| 4,737,198 | 4/1988 | Shabel et al. | 148/437 |
| 4,800,950 | 1/1989 | Crona et al. | 164/467 |
| 4,802,935 | 2/1989 | Crona et al. | 148/437 |
| 4,806,211 | 2/1989 | Timm et al. | 204/29 |
| 5,030,416 | 4/1991 | Werner et al. | 420/538 |
| 5,080,728 | 1/1992 | Hasenclever | 148/437 |
| 5,148,862 | 9/1992 | Hashiura et al. | 420/538 |

FOREIGN PATENT DOCUMENTS

| | | | |
|---|---|---|---|
| 362127 | 8/1989 | European Pat. Off. . | |
| 53-146210 | 12/1978 | Japan | 148/437 |
| 64-034548 | 2/1989 | Japan . | |

OTHER PUBLICATIONS

F. Wehner et al., "Selecting Aluminum Alloys For Light Weight Heat Exchanger Fins", Z. Werkstofftech, vol. 17(2), pp. 48–52., (1986).

R. Mahmudi et al., "Mechanical Properties and Formability of Fine Grained Aluminum Alloy Sheet", Aluminum, vol. 63(1), pp. 62–66, (1987).

R. J. Dean et al., "Production of High Quality Aluminum Foil", Int. J. of Materials and Product Technology, vol. 2 Nos. 3/4, pp. 281–295, (1987).

P. Griffin, "Manufacture of Light Gauge Aluminum Foil", Foil, vol. 8, No. 7, pp. 21–23, Oct./Nov. 1989.

*Primary Examiner*—John Zimmerman
*Attorney, Agent, or Firm*—Gary P. Topolosky

[57] ABSTRACT

There is claimed an aluminum alloy sheet product having a composition consisting essentially of: about 1.35–1.6 wt. % iron; about 0.3–0.6 wt. % manganese; about 0.1–0.4 (and preferably about 0.22–0.4) wt. % copper; about 0.05–0.1 wt. % titanium; about 0.01–0.02 wt. % boron; up to about: 0.2 wt. % silicon, 0.02 wt. % chromium, 0.005 wt. % magnesium and 0.05 wt. % zinc; and a balance of aluminum, incidental elements and impurities. This composition is cast to an initial thickness greater than about 3 mm (0.12 inch). The end product exhibits improved strength and surface properties through a manufacturing process which includes: heat treating at one or more temperatures above about 450° C. (842° F.), and preferably below about 500° C. (932° F.); before rolling to final gauge. When cold rolled to various thicknesses, this sheet product exhibits ultimate tensile strength values ranging from 11–15 kg/mm$^2$ for thin and intermediate gauge products, to about 27–30 kg/mm$^2$ (38.4–42.7 ksi) for the finstocks made hereby. Percent elongations vary from a minimum of 3% to greater than 10%.

25 Claims, 2 Drawing Sheets

ALUMINUM FOIL PRODUCT AND MANUFACTURING METHOD

BACKGROUND OF THE INVENTION

1. Field of the Invention

This invention relates to aluminum alloy sheet products and methods for making such products. More particularly, the invention relates to a method for making aluminum foil products having improved surface characteristics, i.e., substantially no pinholes or streaks, with high burst strengths, bulge heights, ultimate tensile strengths and percent elongations at thin gauges.

2. Technology Review

Aluminum sheet products have been made for many years from numerous alloy compositions. End use applications for such products include: radiator and air conditioning finstock in the transportation industry; insulation panel backings in the building trade; closures, including lids and glassware screwtops: and other packaging needs such as household foil and semi-rigid containers. Rolled aluminum sheet may also be used for lithographic plate substrates, electronic condensors and etching foils.

Surface appearance is as critical as tensile strength in many of the foregoing applications. A stronger alloy would not be useful if it produces surface streaks or an unacceptable number of pinholes when rolled to a thin gauge. Conversely, bright and shiny product surfaces serve no purpose on sheet product with deficient tensile strengths. Many of the foregoing characteristics are impacted by the way in which an alloy is heat treated after, or sometimes between, roll reductions. Intermediate gauge products must possess the necessary elongation levels for withstanding repeated passes through today's complicated roll stand arrangements.

It has been known for some time to make rolled sheet product from such alloys as 1145, 1200, 8006, 8011, 8014 and 8079 aluminum (Aluminum Association designations). It has also been known to subject such products to a variety of heat treatment, and annealing conditions for maximizing one product characteristic, usually at the expense of another.

In U.S. Pat. No. 4,483,719, there is claimed a process for making fine-grained aluminum alloy sheet by cooling and annealing within preferred temperature ranges. The alloy consists essentially of: 0.8–1.5 wt. % iron; up to 0.5 wt. % manganese; up to 0.5 wt. % silicon; up to 0.3 wt. % of any one impurity, the total impurities level not exceeding 0.8 wt. %; and a balance of aluminum.

U.S. Pat. Nos. 4,800,950 and 4,802,935 show a lithographic plate substrate consisting essentially of 1.1–1.8 wt. % iron, 0.1–0.4 wt. % silicon, 0.25–0.6 wt. % manganese, up to 0.3 wt. % copper, up to 0.8 wt. % magnesium, up to 2.0 wt. % zinc and 1.0 wt. % of all other elements, each not exceeding 0.3 wt. % in total concentration, and a balance of aluminum. This substrate is cast to a thickness of 5–12 mm (0.2–0.47 inch) before annealing at 270° C. (518° F.) for 3 hours.

The anodized product of U.S. Pat. No. 4,806,211 comprises 1.2–1.6 wt. % iron, 0.25–0.55 wt. % manganese, up to 0.2 wt. % silicon, up to 0.3 wt. % copper, up to 5.0 wt. % magnesium, up to 0.1 wt. % chromium, up to 2.0 wt. % zinc, up to 0.25 wt. % zirconium, up to 0.1 wt. % titanium, up to 0.5 wt. % other elements and a balance of aluminum.

Japanese Patent No. 64-34,548 claims a method for making high strength foil from a composition containing 0.8–2 wt. % iron; at least one of: 0.1–1 wt. % silicon, 0.01–0.5 wt. % copper, 0.01–0.5 wt. % magnesium, 0.01–1 wt. % manganese; 0.1 wt. % or less titanium and/or 0.05 wt. % or less boron; and a balance of aluminum and impurities. This composition is cast to less than 3 mm (0.12 inch), then annealed at 200°–450° C. (392°–842° F.).

Despite the foregoing advancements, there is still need for: aluminum foil product that possesses a better combination of high strength and good surface characteristics; as well as improved methods for making such products. The present invention serves both needs.

SUMMARY OF THE INVENTION

It is a principal objective of this invention to provide an aluminum alloy sheet product having improved strength levels and surface characteristics at thin gauges. It is another objective to achieve such improved characteristics through both manufacturing and composition modifications. It is another objective to develop a new sheet product composition whose alloying additives will not cause intermetallics to form and/or coarsen before crystallizing out. It is still another objective to provide aluminum foil products with small average grain sizes, substantially no pinholes or surface streaks and high tensile strengths, burst strengths, buckle heights and percent elongations. It is yet another objective to provide an aluminum alloy sheet product whose high strengths and good unwinding characteristics will enable faster rolling speeds thereby increasing overall foil productivity.

It is another principal objective of this invention to provide a method for manufacturing aluminum foil products having tensile strengths and percent elongations that exceed those for comparable or thinner gauges of 1200, 1145, 8011 or 8014 alloy products. Another objective is to provide an improved foil manufacturing method that imparts high strengths and excellent surface properties to a new composition using new combinations of heat treatments. A reduced number of pinholes is especially critical to those applications requiring non-permeability such as for insulation and packaging purposes. A good product surface is essential for situations where coloring or lacquering may be applied through subsequent processing. Another objective is to make label stock. It is also possible to make foil of thinner gauges keeping the same properties with less weight and the same area for the thin gauge foil.

These and other objectives/advantages of the present invention are achieved by an aluminum alloy sheet product whose composition consists essentially of: about 1.35–1.6 wt. % iron; about 0.3–0.6 wt. % manganese; about 0.1–0.4 (and preferably greater than about 0.22) wt. % copper; about 0.05–0.1 wt. % titanium; about 0.01–0.02 wt. % boron; up to about: 0.2 wt. % silicon, 0.02 wt. % chromium, 0.005 wt. % magnesium and 0.05 wt. % zinc; and a balance of aluminum, incidental elements and impurities. This composition is cast to a thickness greater than about 3 mm (0.12 inch) then subjected to a manufacturing process which includes: heat treating at one or more temperatures above about 450° C. (842° F.), and preferably between about 460°–500° C. (860°–932° F.); before cold rolling to produce sheet product that exhibits improved strength and surface properties.

When cold rolled to a substantially uniform thickness of about 0.07–0.13 mm (0.0028–0.0051 inch) and heat treated, this invention produces finstock having about 5–6% elongation and an ultimate tensile strength ("U.T.S.") preferably between about 27–30 kg/mm$^2$ (38.4–42.7 ksi). When cold rolled to about 0.02–0.045 mm (0.0008–0.0018 inch) and further heat treated, this sheet product exhibits at least about 10% elongation and preferable U.T.S. values between about 13–15 kg/mm$^2$ (18.5–21.3 ksi). When further cold rolled to about 0.009–0.016 mm (0.0004–0.0006 inch), this sheet product exhibits about 5–6% elongation and an ultimate strength between about 12–14 kg/mm$^2$ (17.1–19.9 ksi). When cold rolled to a final gauge below about 0.009 mm (0.0004 inch), the invention makes thin gauge foil-type products having a U.T.S. between about 11–13 kg/mm$^2$ (15.6–18.5 ksi), less than about 50 pinholes/m$^2$ and about 3–4% elongation.

BRIEF SUMMARY OF THE DRAWINGS

Further features, objectives and advantages of this invention will be made clearer by reference to the accompanying drawings wherein.

DETAILED DESCRIPTION OF THE PREFERRED EMBODIMENTS

Figure 1:
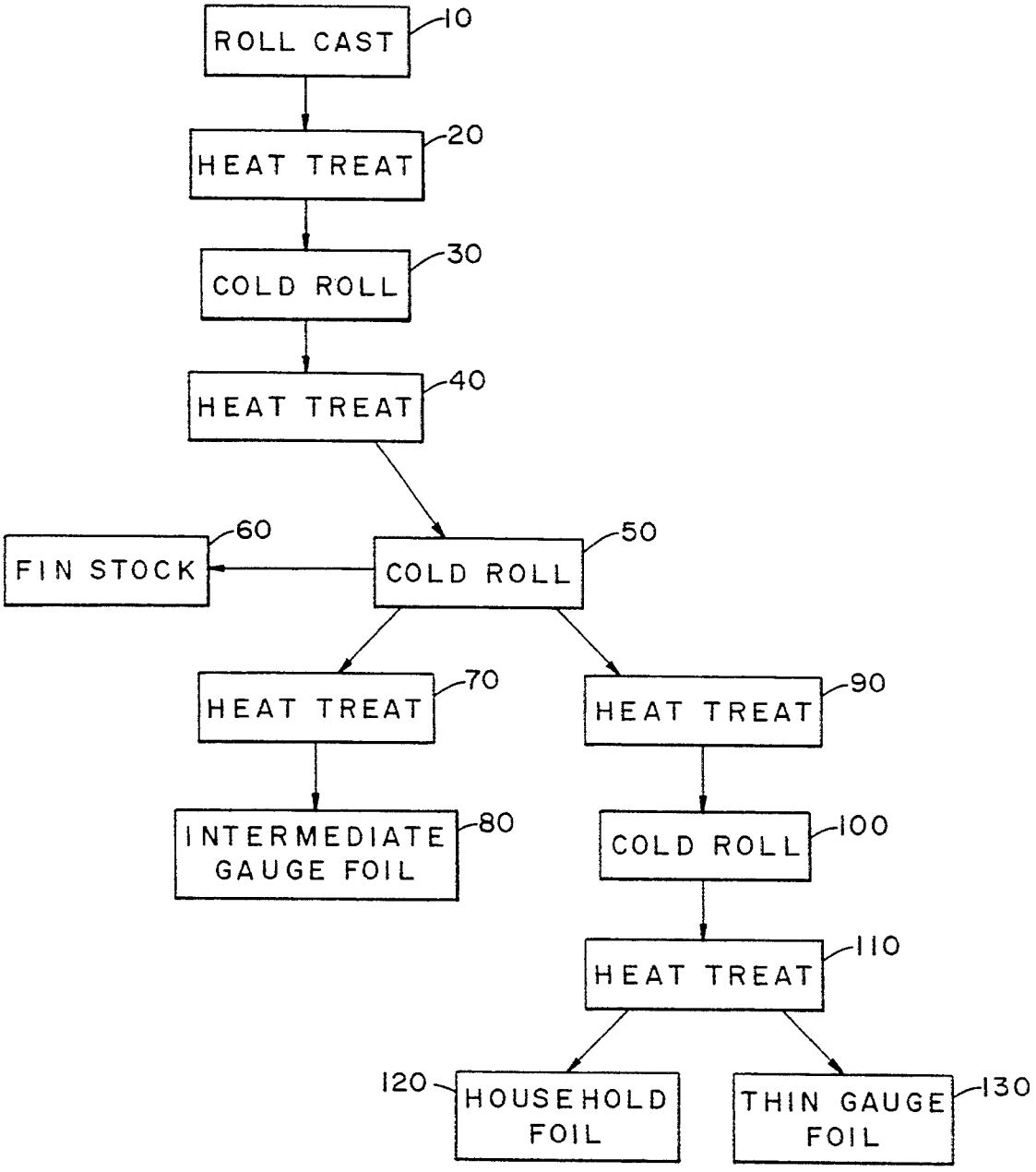
FIG. 1 is a flow chart outlining various steps for making improved foil products according to the invention.

With respect to this invention:

(a) The term "ksi" is equivalent to killipounds per square inch;

(b) The term "substantially uniform thickness" means a thickness of equivalent dimension across most of the sheet product width, it being understood that thinning may occur at the outermost edges of said product under normal rolling conditions, said outermost edges being removed by periodic trimming steps conducted throughout the foil/finstock manufacturing process;

(c) The term "good unwinding characteristics" means no adherence between the wraps of a coiled roll of foil;

(d) Whenever compositional percentages are given, reference is to % by weight, unless otherwise indicated;

(e) When reciting a numerical range for any compositional element, operating temperature, strength level, % elongation or other value, such ranges are intended to designate and disclose each number, including every fraction and/or decimal, between the stated minimum and maximum for said range, beyond the customary rules for rounding off numerical values. For example, 1.35–1.6% Fe includes 1.4, 1.45, 1.5% Fe, and so on up to 1.6 wt. % iron. Similarly, 450°–550° C. includes temperatures of 451°, 452°, 453°, . . . etc., up to and including 550° C.;

(f) The term "finstock" means both radiator stock and sheet product used for making heater or air conditioner condenser/coil parts, even though said products may vary in final product gauge; and (g) For the various heat treatments described below, the actual heating employed includes subjecting an entire coil of intermediate or final gauge product to elevated temperatures in an oven or furnace. It is to be understood, however, that still other known or subsequently developed means may be employed for treating such products on a batch or continuous basis.

For the present composition, it is believed that iron and manganese are primarily responsible for adding constituent particles to the invention. Copper is added for improving the strength and corrosion resistance. It is known that certain additives may be effective for imparting higher strengths to a given alloy composition. It is still necessary, however, to determine which range of each additive, and which combinations of additives, impart the greatest level of improvement to each desired property. For example, significant increases in copper are known to enhance aluminum alloy strengths. But, copper is also known to cause certain intermetallic compounds to form and/or coarsen. When such intermetallic compounds appear, it is preferred that they crystallize out through subsequent heat treatments, since coarse intermetallics are known to cause foil products to crack or tear during rolling.

For the invention alloy, silicon contents are controlled to avoid the formation of such intermetallic compounds as AlFeSi and/or AlMnSi. Both boron and titanium are essential for improving the formation of average grain sizes of 5 microns or less. On a preferred basis, the invention exhibits average grain sizes between about 5 and 10 microns. Ti and B levels also contribute to overall product homogeneity and its ability to avoid forming center line segregations.

When the dendrites that form during casting are substantially pure aluminum, streaking will occur on the matte side of most rolled products. Such streaks cause these products to only partially anneal thus affecting their toughness properties and particle strain hardening characteristics. The invention avoids the formation of such surface streaks. The good surface characteristics of this invention are critical to subsequent coloring or lacquering stages. A reduced number of pinholes also enables such products to be used for non-permeable applications including insulation panel backings and household foils.

The foregoing composition produces higher base strengths in thin gauge products. This enables faster roll speeds to be used, thereby enhancing overall aluminum foil production.

Referring now to FIG. 1, there is shown a flow chart outlining the principal steps for manufacturing preferred embodiments of this invention. Various edge-trimming steps, subsequent to most cold rolling operations, have been deleted from this flow chart as they are not critical to the overall process. In the initial step, the aforementioned alloy compositions are cast, and preferably roll cast (item 10 in FIG. 1), to a thickness greater than about 3 or 3.3 mm (0.12 or 0.13 inch), preferably to between about 4.8–10 mm (0.19–0.39 inch), and most preferably to a substantially uniform thickness between about 5 and 5.5 mm (0.2–0.21 inch). Such roll casting produces a first intermediate, illustrated as item 1 in FIG. 2. The quality of such slab thicknesses are preferred for this invention because of the better strain handling properties imparted thereby; better control of caster parameters; allowing larger range of caster parameter for eventual correction like level, temperature, sticking and better profile control.

In the as-cast condition, this first intermediate possesses an ultimate tensile strength ("U.T.S.") between about 18–19 kg/mm$^2$ (25.6–27 ksi), a yield strength of about 14–15 kg/mm$^2$ (19.9–21.3 ksi) and about 16–18% elongation.

After roll casting, first intermediate 1 is subjected to a pre-cold roll heat treatment (step 20). Preferred embodiments thereof include: heating this intermediate for more than 4 hours, and preferably for about 6 or more hours at one or more temperatures above 450° C. (842° F.), preferably between about 450°–550° C. (842°–1022° F.), and most preferably between about 460°–500° C. (860°–932° F.). When first intermediate 1 is preheated as soon as possible after casting, alloy product microstructure may be better controlled. The preferred "preheating" temperatures described above are critical to achieving the desired combinations of properties described hereafter. If heat treatment takes place at temperatures lower than 450° C. (842° F.), the invention will not reach the elongation levels necessary for subsequent cold rolling stages. If temperatures higher than 550° C. (1022° F.) are used, such sheet products will develop large surface grain sizes which will detrimentally affect mechanical properties and surface cosmetics. In some instances, undesirable surface features have begun to appear on sheet products preheated above 500° C. (932° F.). Electrical conductivity values (% I.A.C.S.) for first intermediates subjected to heat treating temperatures ranging from 440° C. to 520° C. also bear out the importance of using preferred temperatures at or below 500° C. (932° F.).

"Preheating" for 5 or 6 hours at one or more temperatures between about 465°–500° C. (869°–932° F.) is most preferred. It results in a first intermediate having a bimodal distribution of particles. A first population of large particles forms during solidification while a second population of finer particles forms through the preheat. A preferred Fe content of about 1.4–1.5 wt. % is primarily responsible for these large constituent particles, i.e., those greater than 0.002 mm in size, while the preferred Mn content of about 0.4–0.6 wt. % influences the population of smaller particles, those at or below 0.005 mm.

After heat treatment, first intermediate 1 is cold rolled, item 30 in FIG. 1, to reduce its thickness, preferably by as much as about 92 to 95%. This results in a second intermediate, item 2 in FIG. 2, whose substantially uniform thickness is at or below about 0.4 mm (0.016 inch), and preferably between about 0.31– 0.38 mm (0.012–0.15 inch). Such processing typically takes place between a pair of rotating rolls.

Second intermediate 2 is next subjected to a nonhomogenizing heat treatment, item 40 in FIG. 1, which includes: heating at one or more elevated temperatures below about 300° C. (572° F.) for less than 4 hours, and preferably between about 200°–250° C. (392°–482° F.) for about 0.4–3.5 total hours. The sheet product resulting from this heat treatment is suitable for use as automotive finstock, item 60 in FIG. 1. It possesses an excellent average grain size, good surface characteristics, and improved strength levels, especially when compared to preexisting finstock alloys such as 8011.

TABLE I

| | FINSTOCK | |
|---|---|---|
| | Standard | Invention |
| Alloy/Temper | 8011-H18 | 8000-H18 |
| Gauge (mm) | 0.110 | 0.080 |
| (in) | .0043 | .0031 |
| UTS (kg/mm$^2$) | 18.0 | 26.0–28.0 |
| E (%) | 2.0–3.0 | 5.0–6.0 |

The preferred final pass for each rolling step described herein takes place according to standard practices. This includes passing feedstock, usually as it unwinds from a coil produced during the previous thickness reduction step, in an overlapping manner through a pair of rolls (or double rolls). The edges of each last unwinding are then trimmed to produce two sheets of coiled end product, each sheet having a bright side and matte side. The practice of a new manufacturing process on this new alloy composition results in a sheet product whose matte side is virtually free of surface streaks while still exhibiting high strength values. This same sheet product possesses a minimal amount of pinholes, usually on the order of 50 pinholes or less per square meter.

When making an intermediate gauge foil product, or one having a substantially uniform thickness between about 0.02–0.045 mm (0.0008–0.0018 inch), the second intermediate product resulting from prior heat treatment stage 40, is next subjected to further cold rolling, item 50 in FIG. 1, to reduce its overall thickness by about 87 to 94%. Such rolling causes third intermediate, item 3 in FIG. 2, to form thereby. This third intermediate is then subjected to one last heat treatment (item 70) which includes: heating to one or more temperatures between about 300°–400° C. (572°–752° F.), preferably for about 2 or more hours. The end result is an intermediate gauge foil product 80 which has the following combination of improved properties when compared with similarly-sized product made from 8011 aluminum (Aluminum Association designation).

TABLE II

| | INTERMEDIATE GAUGE FOIL | | | | |
|---|---|---|---|---|---|
| | Thickness | UTS (kg/mm$^2$) | % Elong. | Burst Strength (lb/in$^2$) | Bulge Height |
| Invention | 0.025–0.030 mm 0.0009–0.0011 in | 14 | 11–13 | 36–42 | 9 mm 0.354 in |
| 8011 | 0.025–0.030 mm 0.0009–0.0011 in | 8–9 | 8–10 | 25–29 | 7–8 mm 0.275–0.315 in |

If still thinner gauges are desired, third intermediate 3 may be subjected to yet another heat treatment, item 90, after cold rolling operation 50. This heat treatment preferably takes place at one or more temperatures between about 200°–300° C. (392°–572° F.). Thereafter, a third cold roll reduction, item 100, is performed. This is followed by a final heat treatment, item 110, preferably consisting of: heating to one or more temperatures between about 300°–400° C. (572°–752° F.) for 2 or more hours. Depending on the final gauge desired, this results in either a household foil product 120 having a substantially uniform thickness between about 0.009–0.016 mm (0.0004–0.0006 inch), or a very thin gauge foil product, item 130, whose substantially uniform thickness is less than about 0.009 mm (0.0004 inch), and preferably between about 0.005–0.008 mm (0.0002–0.0004 inch). A tabular comparison of properties for various household gauge foils follows. Table III shows how this invention outperforms equivalent products made from 1145, 1200, 8006 and 8011 aluminum.

TABLE III

| | HOUSEHOLD FOILS | | | | |
|---|---|---|---|---|---|
| | Thickness (mm/in) | UTS kg/mm$^2$ | % Elong. | Burst Strength (lb/cm$^2$) | Bulge Height (mm/in) |
| Invention | 0.011/0.00043 | 12–13 | 5–6 | 14–15 | 6.5/0.248 |
| 1145 | 0.014/0.00055 | 5.0 | 3.1 | 8.0 | 3.3/0.130 |
| 1145 | 0.016/0.00063 | 5.3 | 3.5 | 8.0 | 4.4/0.173 |
| 1145 | 0.017/0.00067 | 6.3 | 3.8 | 8.0 | 3.6/0.142 |
| 1200 | 0.016/0.00063 | 7.5 | 3.0 | 10.2 | 3.0/0.118 |
| 8006 | 0.013/0.00051 | 9.6 | 4.7 | 11.6 | 5.5/0.358 |
| 8006 | 0.014/0.00055 | 9.3 | 4.6 | 11.6 | 4.4/0.173 |

TABLE III-continued

| HOUSEHOLD FOILS | Thickness (mm/in) | UTS kg/mm² | % Elong. | Burst Strength (lb/cm²) | Bulge Height (mm/in) |
|---|---|---|---|---|---|
| 8011 | 0.014/0.00055 | 8.7 | 4.4 | 11.63 | 4.4/0.173 |

Very thin gauge foil, manufactured according to the invention, is next compared to a similarly-sized 1145 aluminum alloy foil product.

TABLE IV

| THIN GAUGE FOIL | Thickness (mm/in) | UTS (kg/mm²) | % Elong. | # Pinholes/ft² |
|---|---|---|---|---|
| Invention | 0.0065/0.000255 | 11–12 | 3–4 | 7 |
| 1145 | 0.007/0.000275 | 5.0 | 1–2 | 40 |

Figure 2:
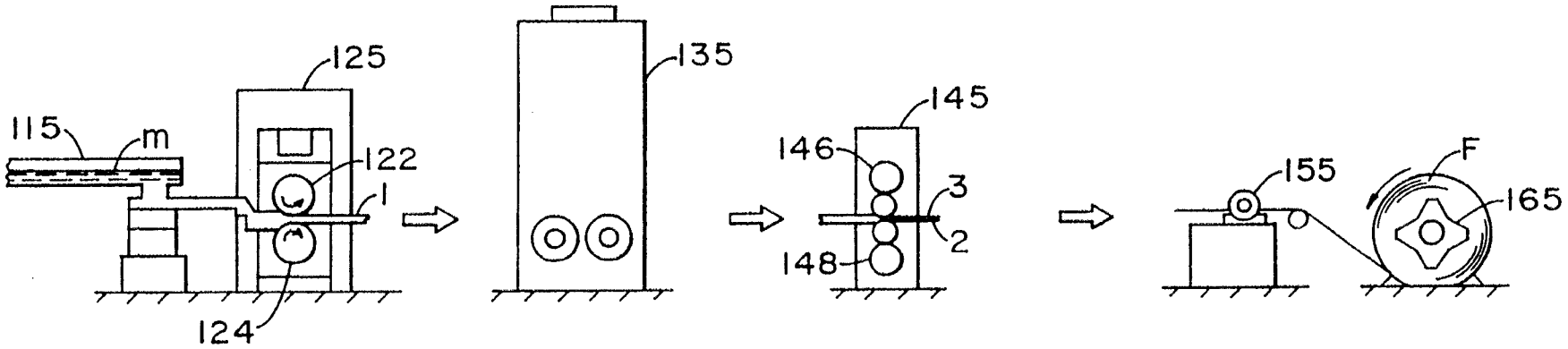
FIG. 2 is a schematic, side view showing one means for practicing a preferred embodiment hereof.

Referring now to FIG. 2, there is shown some of the typical equipment for manufacturing foil product according to a preferred embodiment of the invention. It is to be understood, however, that any practice of this method should not be limited to the equipment so depicted as various existing, or subsequently developed, apparatus may be substituted for any portion of the equipment hereafter described.

FIG. 2 shows a casting tundish 115 into which is poured from a heated crucible (not shown) molten metal m having the preferred compositional limits set forth above. Molten metal m is cast to solidify and form a first intermediate 1 between rollers 122 and 124 of rolling stand 125. A second intermediate 2 exiting these rolls is subjected to heat treatment within furnace 135. Preferred embodiments actually require heating an entire coil of intermediate product after initial gauge reduction, however. After exiting furnace 135, second intermediate 2 is passed through second roll stand 145 to impart a further thickness reduction thereon. This latter stand includes a separate pair of upper 146 and lower rolls 148. The sheet product exiting this stand produces a third intermediate 3 which may be heat-treated in an oven/furnace similar to item 135, depending on the product's intended end use. Repeated heat treatments are not depicted in the FIG. 2 schematic, however.

Third intermediate 3 is finally passed through trimmer stand 155 to effect a final edge trimming thereon. One (or two) coils of finished end product F may then be wound up using a plurality of coiler units 165. Subsequent processing steps for still thinner gauge product would include making repeated passes through roll stand 145, furnace 135 and perhaps even trimmer 155. Each resulting aluminum foil, in any event, includes a matte side (or roll-contacting surface) and bright side (or foil-contacting surface).

Having described the presently preferred embodiments, it is to be understood that the invention may be otherwise embodied within the scope of the appended claims.

What is claimed is:

1. An aluminum alloy sheet product having: (a) a composition consisting essentially of about 1.35–1.6 wt. % iron, about 0.3–0.6 wt. % manganese, about 0.1–0.4 wt. % copper, about 0.05–0.1 wt. % titanium, about 0.01–0.02 wt. % boron, and up to about 0.2 wt. % silicon, the balance being aluminum, incidental elements and impurities; (b) an as-cast thickness between about 4.8–10 mm (0.19–0.39 inch); and (c) improved strength and surface properties from having been subjected to a manufacturing method that includes: heat treating at one or more temperatures above about 450° C. (842° F.) for more than about 4 hours; and cold rolling to final gauge.

2. The sheet product of claim 1 which further includes at least one of: up to about 0.02 wt. % chromium, up to about 0.005 wt. % magnesium and up to about 0.05 wt. % zinc.

3. The sheet product of claim 1 wherein said composition includes greater than 0.2 wt. % copper.

4. The sheet product of claim 1 wherein the manufacturing method includes: heat treating at one or more temperatures between about 460°–500° C. (860°–932° F.) for 5 or more hours; cold rolling to a thickness between about 0.02–0.045 mm (0.0008–0.0018 inch); and further heat treating to make an intermediate foil having an ultimate tensile strength of at least about 12 kg/mm² (17.1 ksi).

5. The sheet product of claim 4 wherein said intermediate foil has an ultimate tensile strength between about 13–15 kg/mm² (18.5–21.3 ksi) and at least about 10% elongation.

6. The sheet product of claim 1 wherein the manufacturing method includes: heat treating at one or more temperatures between about 460°–500° C. (860°–932° F.) for 5 or more hours; and cold rolling to a thickness between about 0.009–0.016 mm (0.0004–0.0006 inch) to make a household foil having an ultimate tensile strength of at least about 11 kg/mm² (15.6 ksi).

7. The sheet product of claim 6 wherein said household foil has a burst strength of about 14–15 lb/in², a buckle height of about 6–6.5 mm, an ultimate tensile strength between about 12–14 kg/mm² (17.1–19.9 ksi) and between about 5–6% elongation.

8. The sheet product of claim 1 wherein the manufacturing method includes: heat treating at one or more temperatures between about 460°–500° C. (860°–932° F.) for 5 or more hours; cold rolling to a thickness of about 0.009 mm (0.0004 inch) or less; and further heat treating to make a thin gauge foil having an ultimate tensile strength of at least about 10 kg/mm² (14.2 ksi).

9. The sheet product of claim 8 wherein said thin gauge foil has an ultimate tensile strength between about 11–13 kg/mm² (15.6–18.5 ksi); less than about 50 pinholes/m² and between about 3–4% elongation.

10. The sheet product of claim 1 wherein the manufacturing method includes: heat treating at one or more temperatures between about 460°–500° C. (860°–932° F.) for 5 or more hours; cold rolling to a thickness between about 0.07–0.13 mm (0.0028–0.0051 inch); and further heat treating to make a finstock having an ultimate tensile strength of at least about 25 kg/mm² (35.5 ksi).

11. The sheet product of claim 10 wherein said finstock has an ultimate tensile strength between about 27–30 kg/mm² (38.4–42.7 ksi) and between about 5–6% elongation.

12. A method for manufacturing finstock having a small average grain size, an ultimate tensile strength of at least about 25 kg/mm² (35.5 ksi) and about 5–6% elongation, said method comprising:

(a) providing an alloy consisting essentially of about 1.35–1.6 wt. % iron, about 0.3–0.6 wt. % manganese, about 0.22–0.4 wt. % copper, about 0.05–0.1 wt. % titanium, about 0.01–0.02 wt. % boron, up to about 0.2 wt. % silicon, up to about 0.02 wt. % chromium, up to about 0.005 wt. % magnesium and up to about 0.05 wt. % zinc, the balance being aluminum, incidental elements and impurities;

(b) casting the alloy into a first intermediate having an as-cast thickness between about 4.8–10 mm (0.19–0.39 inch);

(c) heat treating the first intermediate at one or more temperatures above about 450° C. (842° F.) for more than about 4 hours:

(d) cold rolling the first intermediate to make a second intermediate having a substantially uniform thickness of about 0.4 mm (0.016 inch) or less;

(e) heat treating the second intermediate at one or more temperatures below about 400° C. (752° F.); and (f) cold rolling the second intermediate to a substantially uniform thickness between about 0.07–0.13 mm (0.0028–0.0051 inch).

13. The method of claim 12 wherein step (c) includes heating the first intermediate at one or more temperatures between about 460°–550° C. (860°–932° F.) for about 6 or more hours.

14. The method of claim 12 wherein step (e) includes heating the second intermediate at one or more temperatures between about 200°–300° C. (392°–572° F.) for about 0.4–3.5 hours.

15. A method for manufacturing an intermediate gauge foil product having substantially no pinholes or surface streaks, said method comprising:

(a) providing an alloy consisting essentially of about 1.35–1.6 wt. % iron, about 0.3–0.6 wt. % manganese, about 0.22–0.4 wt. % copper, about 0.05–0.1 wt. % titanium, about 0.01–0.02 wt. % boron, up to about 0.2 wt. % silicon, up to about 0.02 wt. % chromium, up to about 0.005 wt. % magnesium and up to about 0.05 wt. % zinc, the balance being aluminum, incidental elements and impurities;

(b) casting the alloy into a first intermediate having an as-cast thickness between about 4.8–10 mm (0.19–0.39 inch);

(c) heat treating the first intermediate at one or more temperatures above about 450° C. (842° F.) for more than about 4 hours;

(d) cold rolling the first intermediate to make a second intermediate having a substantially uniform thickness of about 0.4 mm (0.016 inch) or less;

(e) heat treating the second intermediate at one or more temperatures below about 300° C. (572° F.) for less than about 4 hours;

(f) cold rolling the second intermediate to make a third intermediate having a substantially uniform thickness between about 0.02–0.045 mm (0.0008–0.0018 inch); and (g) heat treating the third intermediate at one or more temperatures between about 300°–400° C. (572°–752° F.) for about 0.4–4 hours.

16. The method of claim 15 wherein step (c)includes heating the first intermediate at one or more temperatures between about 460°–500° C. (860°–932° F.) for about 6 hours or more.

17. The method of claim 15 wherein step (e) includes heating the second intermediate at one or more temperatures between about 200°–250° C. (392°–482° F.) for about 0.4–3.5 hours.

18. The method of claim 15 wherein the third intermediate of step (f) has a substantially uniform thickness between about 0.02–0.045 mm (0.0008–0.0018 inch).

19. A method for manufacturing a thin gauge household foil having a small average grain size, high burst strength and buckle height, substantially no pinholes or surface streaks, and good unwinding characteristics, said method comprising:

(a) providing an alloy consisting essentially of about 1.35–1.6 wt. % iron, about 0.3–0.6 wt. % manganese, about 0.22–0.4 wt. % copper, about 0.05–0.1 wt. % titanium, about 0.01–0.02 wt. % boron, up to about 0.2 wt. % silicon, up to about 0.02 wt. % chromium, up to about 0.005 wt. % magnesium and up to about 0.05 wt. % zinc, the balance being aluminum, incidental elements and impurities;

(b) casting the alloy into a first intermediate having an as-cast thickness between about 4.8–10 mm (0.19–0.39 inch);

(c) heat treating the first intermediate at one or more temperatures above about 450° C. (842° F.) for at least about 4½ hours;

(d) cold rolling the first intermediate to make a second intermediate having a substantially uniform thickness of about 0.4 mm (0.016 inch) or less;

(e) heat treating the second intermediate at one or more temperatures between about 200°–300° C. (392°–572° F.);

(f) cold rolling the second intermediate to make a third intermediate having a substantially uniform thickness between about 0.03–0.05 mm (0.0012–0.0020 inch);

(g) heat treating the third intermediate at one or more temperatures between about 200°–300° C. (392°–572° F.) for less than about 4 hours;

(h) cold rolling the third intermediate to make a thin gauge household foil having a substantially uniform thickness of about 0.019 mm (0.0008 inch) or less; and (i) heat treating the thin gauge household foil at one or more temperatures between about 300°–400° C. (572°–752° F.).

20. The method of claim 19 wherein said third intermediate has a substantially uniform thickness between about 0.035–0.04 mm (0.0014–0.0016 inch); and said thin gauge household foil has a substantially uniform thickness between about 0.009–0.016 mm (0.0004–0.0006 inch).

21. The method of claim 19 wherein said third intermediate has a substantially uniform thickness between about 0.040°–0.045 mm (0.0016–0.0018 inch); and said thin gauge household foil has a substantially uniform thickness between about 0.005–0.009 mm (0.0002–0.0004 inch).

22. The method of claim 19 wherein said thin gauge household foil has less than about 50 pinholes/$m^2$.

23. In a method for manufacturing an aluminum alloy foil product by providing an aluminum-based alloy composition, casting the composition between a pair of rotating rolls to make a first intermediate, and cold rolling the first intermediate to reduce its thickness the improvement which comprises: providing an alloy composition consisting essentially of about 1.35–1.6 wt. % iron, about 0.3–0.6 wt. % manganese, about 0.22–0.4 wt. % copper, about 0.05–0.1 wt. % titanium, about 0.01–0.02 wt. % boron, up to about 0.2 wt. % silicon, up to about 0.02 wt. % chromium, up to about 0.005 wt. % magnesium and up to about 0.05 wt. % zinc, the balance being aluminum, incidental elements and impurities; casting the alloy composition to an as-cast thickness of between about 4.8–10 mm (0.19–0.39 inch); and heat treating the first intermediate at one or more temperatures above about 450° C. (842° F.) for more than about 4 hours prior to cold rolling.

24. The improvement of claim 23 wherein the first intermediate is heat treated at one or more temperatures between about 460°-500° C. (860°-932° F.) for 5 or more hours.

25. The improvement of claim 23 which includes: heat treating after cold rolling.

* * * * *